US010914461B2

(12) United States Patent
Jackson

(10) Patent No.: US 10,914,461 B2
(45) Date of Patent: Feb. 9, 2021

(54) DEVICE TO SUPPORT STRING LIGHTS

(71) Applicant: Mark V. Jackson, Sevierville, TN (US)

(72) Inventor: Mark V. Jackson, Sevierville, TN (US)

( * ) Notice: Subject to any disclaimer, the term of this patent is extended or adjusted under 35 U.S.C. 154(b) by 0 days.

(21) Appl. No.: 16/748,014

(22) Filed: Jan. 21, 2020

(65) Prior Publication Data

US 2020/0263860 A1 Aug. 20, 2020

Related U.S. Application Data

(60) Provisional application No. 62/795,889, filed on Jan. 23, 2019.

(51) Int. Cl.
*F21V 21/088* (2006.01)

(52) U.S. Cl.
CPC ..... *F21V 21/088* (2013.01)

(58) Field of Classification Search
None
See application file for complete search history.

(56) References Cited

U.S. PATENT DOCUMENTS

| | | | | |
|---|---|---|---|---|
| 2,230,900 | A | 2/1941 | Neitzke | |
| 4,462,065 | A | 7/1984 | Rhodes | |
| 4,720,773 | A | 1/1988 | Ahroni | |
| 4,979,085 | A | 12/1990 | Voorhees | |
| 5,915,827 | A | 6/1999 | Wang | |
| 5,984,489 | A | 11/1999 | Rubenstein | |
| 6,017,132 | A | 1/2000 | Miller et al. | |
| 6,203,171 | B1 | 3/2001 | Sherman, Jr. | |
| 6,224,231 | B1 | 5/2001 | Personius | |
| 6,527,413 | B1 | 3/2003 | McIngvale | |
| 7,014,331 | B2 | 3/2006 | Risch et al. | |
| 8,376,584 | B1 | 2/2013 | Jenko et al. | |
| 2007/0008724 | A1 | 1/2007 | Raska | |
| 2012/0198680 | A1 * | 8/2012 | Durben | F16L 3/1218 29/428 |

* cited by examiner

*Primary Examiner* — Vip Patel
(74) *Attorney, Agent, or Firm* — Pitts & Lake. P.C.

(57) ABSTRACT

A device to support string lights, the device including a base member configured with a slot structured to receive a supporting band, and at least one support member extending away from the base member and configured to receive and support a portion of string lights.

12 Claims, 3 Drawing Sheets

DEVICE TO SUPPORT STRING LIGHTS

CROSS-REFERENCE TO RELATED APPLICATIONS

This application claims the benefit of U.S. Provisional Patent Application Ser. No. 62/795,889, filed on Jan. 23, 2019, which is incorporated herein in its entirety by reference.

FIELD OF INVENTION

The present general inventive concept relates to a support for string lights, and, more particularly, to a device that may be affixed to trees to support string lights.

BACKGROUND

Many people enjoy displaying outdoor decorations during holidays such as Christmas. One of the most popular outdoor decorations during such holidays is string lights, which can be arranged in a host of ways to provide color, spell out words, form figures, etc. However, since support for such string lights may be limited outside the home, it would be desirable to provide an easy and convenient way to affix string lights to trees or other existing outdoor structures.

BRIEF SUMMARY

According to various example embodiments of the present general inventive concept, a device is provided that has one or more hook members from which string lights can be hung, and which can be adhered to a tree or other outside structure.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a device to support string lights, the device including a base member configured with a slot structured to receive a supporting band, and at least one support member extending away from the base member and configured to receive and support a portion of string lights.

The foregoing and/or other aspects and advantages of the present general inventive concept may also be achieved by providing a device to support string lights, the device including a base member having front and back surfaces, at least one support member connected to the front surface of the base member and formed with opposite ends that curve toward one another on a front side of the at least one support member so as to receive and support a portion of string lights, a slot formed between the base member and at least one support member and structured to receive a supporting band, and a plurality of gripping protrusions extending from the back surface of the base member.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a string light supporting device is provided which allows a user to easily and conveniently support various portions of a string of string lights such that the lights may be arranged according to the user's wishes. The string light supporting device can be provided on a supporting band (belt, strap, etc.) to that a plurality of the support devices can be arranged to provide various points of support. The devices may be formed with one or more hook portions, of various configurations, from which the string lights may be hung or otherwise supported.

Figure 1:
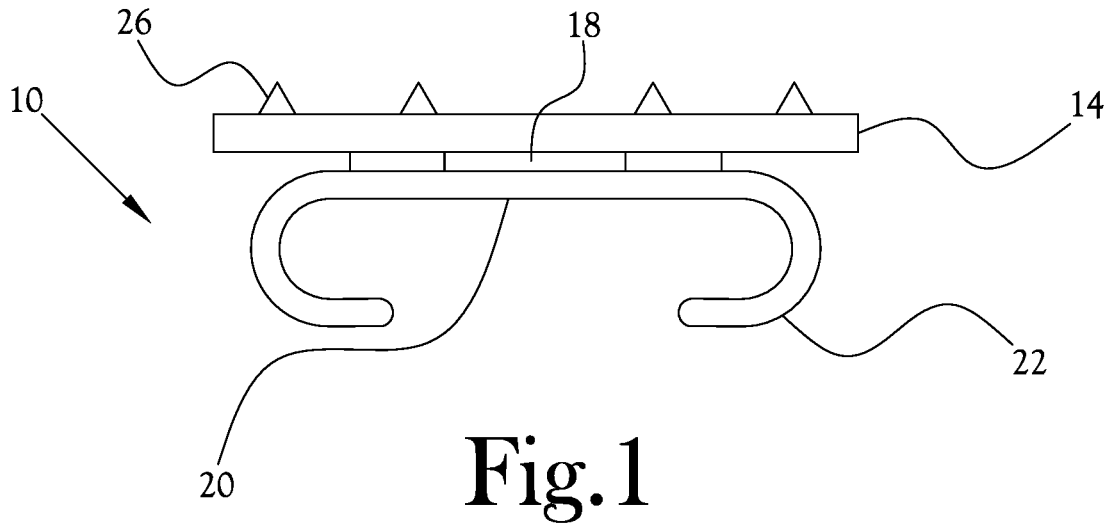
FIG. 1 illustrates a top view of a string light supporting device according to an example embodiment of the present general inventive concept.

FIG. 1 illustrates a top view of a string light supporting device according to an example embodiment of the present general inventive concept. As illustrated in FIG. 1, the string light supporting device 10 includes a base member 14 provided with a support member 20 on one side, the support member 20 having two hooking portions 22 or members formed thereon. Such a support member 20 may be integrally formed along with the base member 14, or may be connected thereto. In various example embodiments, the support member 20 may be selectively attachable to, and detachable from, the base member 14. Various example embodiments may also provide support members 20 with differently formed hooking portions 22, or different types of support structures such as a post around which string lights may be wrapped. In this example embodiment, the two hooking portions 22 or hooks curve toward one another so that two different directions of support may be provided. For example, if the hooks 22 are arranged in a vertical fashion, the bottom hook 22 can hold a section of the string lights simply through gravitational force, while the top hook can hold a section of the string lights that are provided with tension in an upward direction. In other example embodiments one or both of the hooking portions 22 may be structured to be rotatable relative to the support member 20 and/or base member 14. In the example embodiment illustrated in FIG. 1, a slot 18 is formed between the base member 14 and the support member 20, and a supporting band can be received therethrough in order to provide a plurality of the devices 10 placed along a single belt, and/or to provide tension to adhere the devices 10 to a tree or other structure. The surface of the base member 14 opposite the support member 20 is provided with a plurality of protrusions 26, which may be referred to in some example embodiments as gripping protrusions, to form a gripping surface so that the device 10 can be more securely adhered to a tree or other body. In the example embodiment illustrated in FIG. 1, the protrusions 26 are in a conical form that come to a point at distal ends thereof to more easily pierce the bark of a tree.

Figure 2:
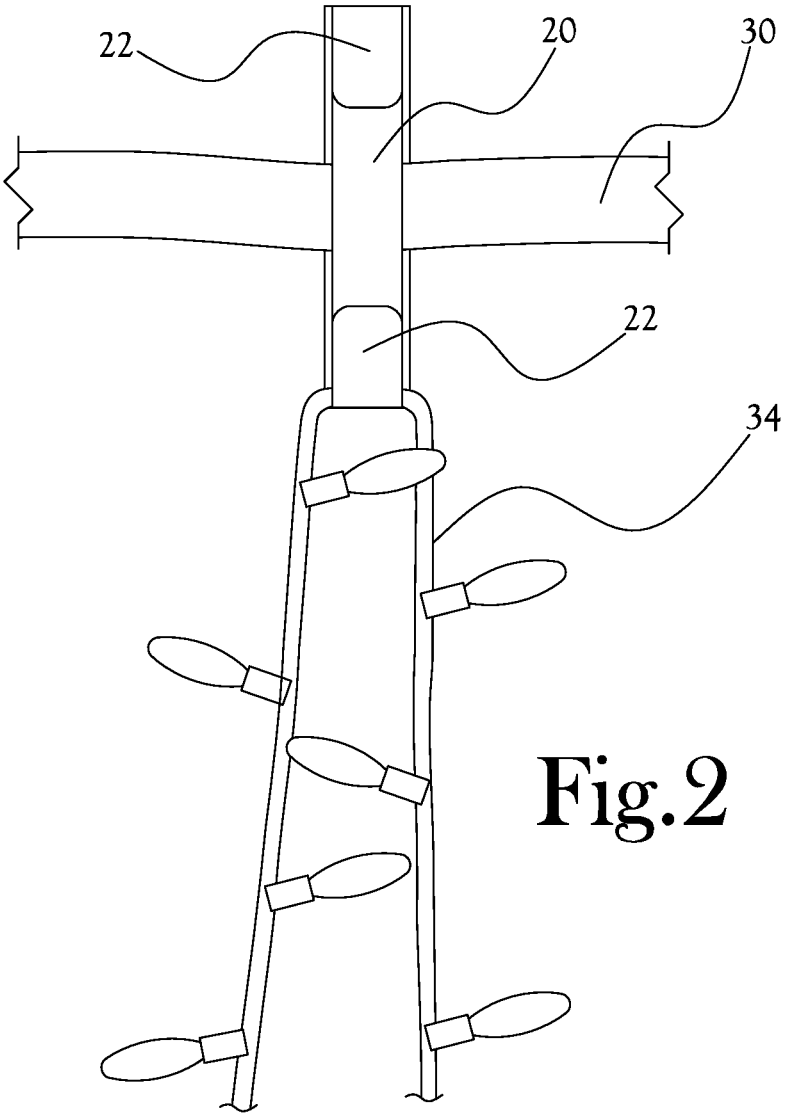
FIG. 2 illustrates a plan view of the device of FIG. 1.

FIG. 2 illustrates a plan view of the device 10 of FIG. 1. In FIG. 2 a supporting band 30 or strap has been received through the slot 18 of the device 10 to tie the device 10 to a tree, and a section of string lights 34 is being supported by the bottom most hook 22. Various example embodiments of the present general inventive concept may have only one hook member 22 or portion, or may have a quantity of hook members 22 greater than two to provide different support possibilities and configurations. Also, various example embodiments may provide support members 20 with configurations and/or protrusions other than hooks, such as, for example, friction fit slots, bosses around which sections of string lights may be wound, selectively closable loops, etc. In various example embodiments the support portion 20 of the device 10 may be rotatable relative to the base member 14, to allow a user to have more freedom of orientation of the support for the string lights 34.

Figure 3:
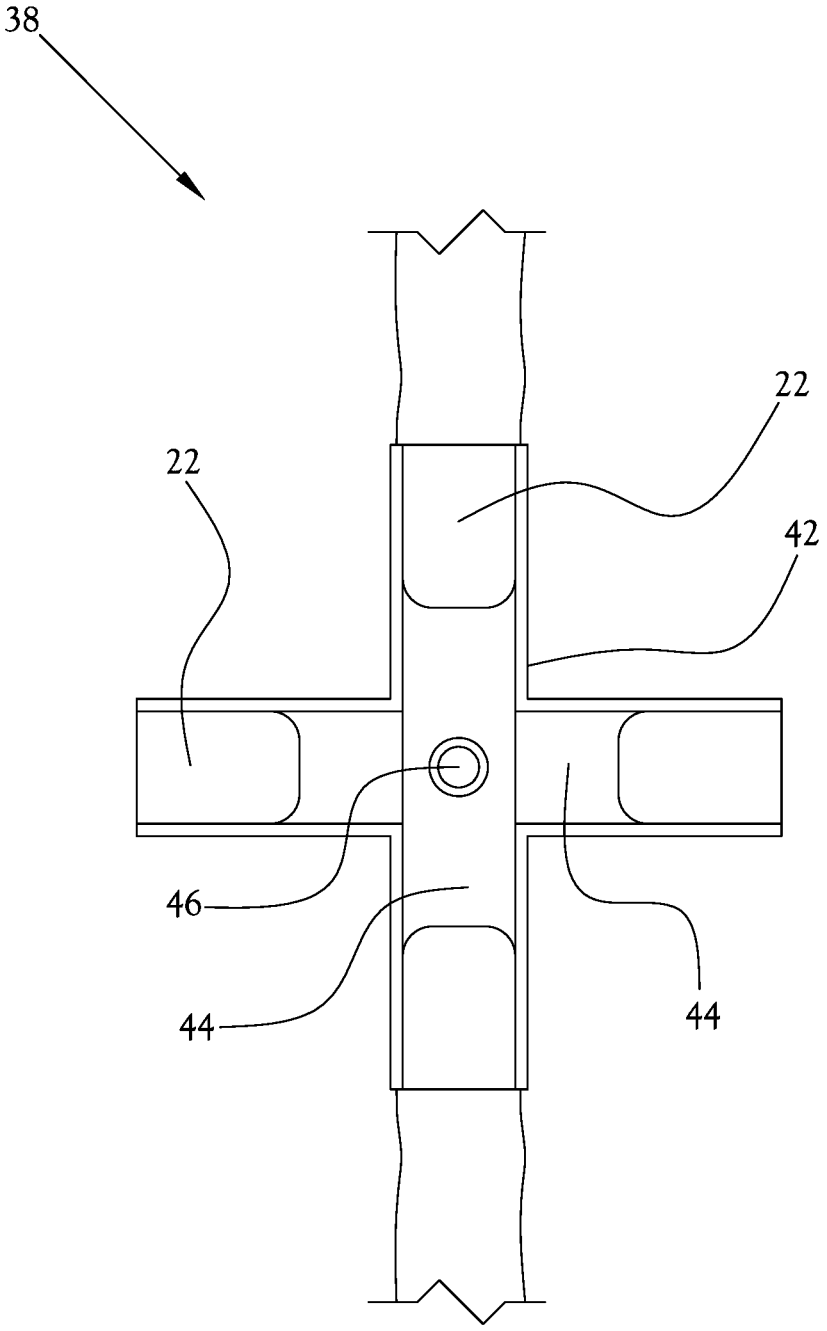
FIG. 3 illustrates a plan view of a string light supporting device according to another example embodiment of the present general inventive concept.

FIG. 3 illustrates a plan view of a string light supporting device according to another example embodiment of the present general inventive concept. In the example embodiment illustrated in FIG. 3, the device 38 has four hook members 22 so as to be able to support lights in four different directions, including two pairs of hooks 22 arranged substantially perpendicularly to each other, each pair of hooks respectively curving inward to face one another. Various example embodiments may provide configurations in which the hook portions 22 curve away from one another. The example embodiment illustrated in FIG. 3 includes a cross-shaped base member 42, but other embodiments may have differently configured base members, such as the base member 14 of FIG. 1. In various example embodiments the device 38 may include a coupling portion to allow two support members 44 to be coupled to one another. In other words, a top support member 44 may be selectively attached and detached to a bottom support member 44 as desired by the user. In other example embodiments a single support member may be include the illustrated four hook arrangement in a single integrated piece. Various example embodiments of the present general inventive concept may also include a through hole through which a securing member may be inserted to more securely fix the device to a surface. Such a feature may allow a user to more permanently install the device to a desired surface. Examples of such a through hole may include a countersunk screw hole 46, such as shown in the example embodiment illustrated in FIG. 3.

Figure 4:
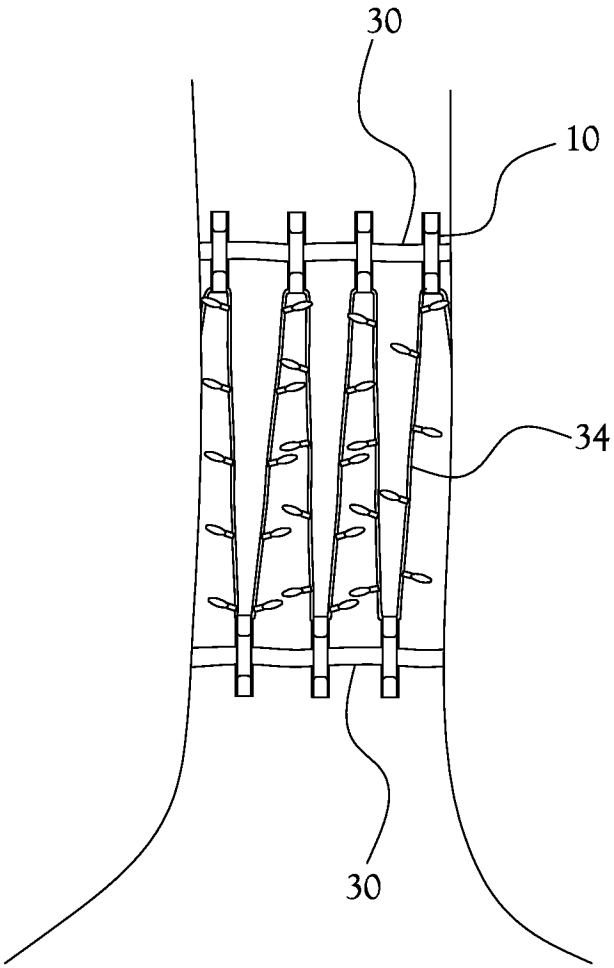
FIG. 4 illustrates a plurality of string light supporting devices being used to support string lights according to an example embodiment of the present general inventive concept.

FIG. 4 illustrates a plurality of string light supporting devices being used to support string lights according to an example embodiment of the present general inventive concept. In FIG. 4, a plurality of the devices 10 have been provided on a strap 30 received through the slots 18 of the respective devices 10, so that a series of the support members 20 and hook portions 22 are provided along a length of the strap. Another similarly arranged series of the devices 10 is provided and spaced apart from the first. With this arrangement, a set of string lights 34 have been wound from one series of the support devices 10 to the other, with the hook portions 22 providing all of the support for the lights 34. The straps 30 wrapping around the tree provide tension support for the devices 10 to the tree, and the protrusions 26 on the back of the devices 10 pierce the tree bark to provide even more adhesion to the tree. Various example embodiments of the devices may not include the protrusions, and instead rely solely on the belt tension.

Figure 5:
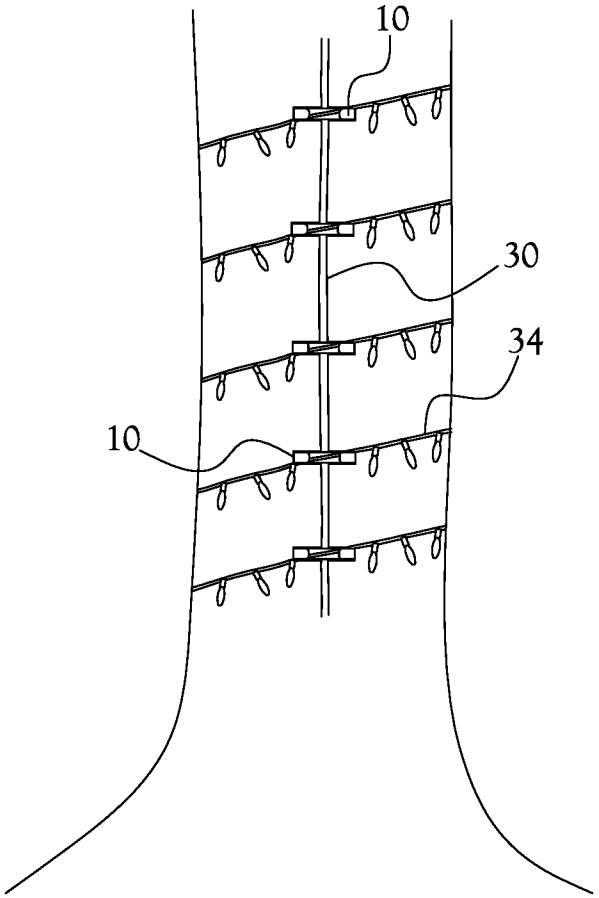
FIG. 5 illustrates a plurality of string light supporting devices being used to support string lights according to another example embodiment of the present general inventive concept.

FIG. 5 illustrates a plurality of string light supporting devices being used to support string lights according to another example embodiment of the present general inventive concept. The arrangement off the devices 10 on the strap 30 is similar to that illustrated in FIG. 4, but only one strap 30 is used in a vertical fashion to provide support for string lights 34 being wrapped around the tree. In such a configuration as this, the devices 10 may rely on the protrusions 26 provided on the backs of the devices 10 to adhere to the tree.

Various example embodiments of the present general inventive concept may provide a device to support string lights, the device including a base member configured with a slot structured to receive a supporting band, and at least one support member extending away from the base member and configured to receive and support a portion of string lights. The slot may be formed between the base member and the at least one support member. The at least one support member may include at least one hook member extending away from the base member and curving to form a receiving portion configured to receive and support a portion of string lights. The at least one hook member may include two hook members arranged substantially opposite one another and curving toward one another. The at least one hook member may include four hook members configured such that two respective pairs of the hook members are each arranged substantially opposite one another and curving toward one another, a first pair of the hook members being arranged substantially perpendicularly to a second pair of the hook members. The at least one support member may include a first support member connected to the base member and having a first pair of hook members arranged substantially opposite one another and curving toward one another, and a second support member configured to be selectively coupled to the first support member and having a second pair of hook members arranged substantially opposite one another and curving toward one another, wherein the second support member is configured to be substantially perpendicular lengthwise to the first support member when coupled to the first support member. The device may further include one or more protrusions extending from a surface of the base member opposite from which the at least one hook member extends, the one or more protrusions configured to provide a gripping surface for the base member. The one or more protrusions may be conical. The one or more protrusions may be configured with a point on a distal end thereof and structured to pierce a surface with which the device is placed in contact. The device may further include a supporting band configured to be received through the slot of one or more of the devices. The slot may be configured to provide a friction fit to the supporting band.

Various example embodiments of the present general inventive concept may provide a device to support string lights, the device including a base member having front and back surfaces, at least one support member connected to the front surface of the base member and formed with opposite ends that curve toward one another on a front side of the at least one support member so as to receive and support a portion of string lights, a slot formed between the base member and at least one support member and structured to receive a supporting band, and a plurality of gripping protrusions extending from the back surface of the base member.

Various example embodiments of the present general inventive concept may provide a device to support string lights, the device including a base member configured with a slot to accept a supporting band, and at least one hook member extending away from the base member and curving to form a receiving portion configured to receive and support a portion of string lights. The device may further include two hook members arranged substantially opposite one another and curving toward one another. The device may further include four hook members configured such that two respective pairs of the hook members are each arranged substantially opposite one another and curving toward one another, a first pair of the hook members being arranged substantially perpendicularly to a second pair of the hook members. The device may further include one or more protrusions extending from a side of the base member opposite from another side of the base member from which the at least one hook member extends, the one or more protrusions configured to provide a gripping surface for the base member. The one or more protrusions may be conical. The one or more protrusions may be configured with a point on a distal end thereof to pierce a surface with which the device is placed in contact. A supporting band may be received through the slot of one or more of the devices. The slot of the one or more of the devices may be configured to provide a friction fit to the supporting band.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A device to support string lights, comprising:

a base member configured with a slot structured to receive a supporting band; and at least one support member extending away from the base member and configured to receive and support a portion of string lights.

2. The device of claim 1, wherein the slot is formed between the base member and the at least one support member.

3. The device of claim 1, wherein the at least one support member comprises at least one hook member extending away from the base member and curving to form a receiving portion configured to receive and support the portion of the string lights.

4. The device of claim 3, wherein the at least one hook member comprises two hook members arranged substantially opposite one another and curving toward one another.

5. The device of claim 3, wherein the at least one hook member comprises four hook members configured such that two respective pairs of the hook members are each arranged substantially opposite one another and curving toward one another, a first pair of the hook members being arranged substantially perpendicularly to a second pair of the hook members.

6. The device of claim 1, wherein the at least one support member comprises:

a first support member connected to the base member and having a first pair of hook members arranged substantially opposite one another and curving toward one another; and a second support member configured to be selectively coupled to the first support member and having a second pair of hook members arranged substantially opposite one another and curving toward one another;

wherein the second support member is configured to be substantially perpendicular lengthwise to the first support member when coupled to the first support member.

7. The device of claim 1, further comprising one or more protrusions extending from a surface of the base member opposite from which the at least one hook member extends, the one or more protrusions configured to provide a gripping surface for the base member.

8. The device of claim 7, wherein the one or more protrusions are conical.

9. The device of claim 7, wherein the one or more protrusions are configured with a point on a distal end thereof and structured to pierce a surface with which the device is placed in contact.

10. The device of claim 1, further comprising a supporting band configured to be received through the slot of one or more of the devices.

11. The device of claim 10, wherein the slot is configured to provide a friction fit to the supporting band.

12. A device to support string lights, comprising:

a base member having front and back surfaces;

at least one support member connected to the front surface of the base member and formed with opposite ends that curve toward one another on a front side of the at least one support member so as to receive and support a portion of string lights;

a slot formed between the base member and at least one support member and structured to receive a supporting band; and a plurality of gripping protrusions extending from the back surface of the base member.

* * * * *